United States Patent [19]

Antonucci et al.

[11] Patent Number: 4,616,230

[45] Date of Patent: Oct. 7, 1986

[54] CONFORMAL PHASED ARRAY ANTENNA PATTERN CORRECTOR

[75] Inventors: John D. Antonucci, Lexington; Peter R. Franchi, Winchester, both of Mass.

[73] Assignee: The United States of America as represented by the Secretary of the Air Force, Washington, D.C.

[21] Appl. No.: 671,393

[22] Filed: Nov. 15, 1984

[51] Int. Cl.[4] ..... H01Q 3/22

[52] U.S. Cl. ..... 342/373; 342/152

[58] Field of Search ..... 343/373, 384, 383, 16 M, 343/427, 420

[56] References Cited

U.S. PATENT DOCUMENTS

| | | | |
|---|---|---|---|
| 3,594,811 | 7/1971 | Paris | 343/854 |
| 3,789,407 | 1/1974 | Rosa et al. | 343/16 M |
| 3,852,761 | 12/1974 | Bogner | 343/754 |
| 3,860,929 | 1/1975 | Crain | 343/427 |
| 3,877,031 | 4/1975 | Mailloux et al. | 343/778 |
| 4,316,192 | 2/1982 | Acoraci | 343/100 SA |
| 4,368,468 | 1/1983 | Lisle et al. | 343/16 M |
| 4,425,567 | 1/1984 | Tresselt | 343/373 |

OTHER PUBLICATIONS

The Handbook of Antenna Design, vol. 1, "Multiple Beam Antennas", pp. 491–492.

Hannan, Peter W. et al., "Study and Design of a Cylindrical Lens Array Antenna for Wideband Electronic Scanning", Rome Air Development Center Interim Report, RADC-TR-83-128, Dec. 1983.

"Radar Handbook", edited by Merrill I. Skolnik, McGraw Hill Book Company, Inc., 1970, pp. 11–50 to 11–52.

*Primary Examiner*—Theodore M. Blum

*Assistant Examiner*—David Cain

*Attorney, Agent, or Firm*—Donald J. Singer; Richard J. Donahue

[57] ABSTRACT

The sum and difference ports of a conformal phased array monopulse antenna are fed in such a manner as to correct for the degraded radiation pattern which would otherwise occur as a function of scan angle.

5 Claims, 6 Drawing Figures

CONFORMAL PHASED ARRAY ANTENNA PATTERN CORRECTOR

STATEMENT OF GOVERNMENT INTEREST

The invention described herein may be manufactured and used by or for the Government for governmental purposes without the payment of any royalty thereon.

BACKGROUND OF THE INVENTION

The present invention relates to radar antenna systems and particularly to a pattern corrector for a conformal phased array monopulse antenna system.

In certain monopulse radar applications, such as aboard aircraft, it becomes advantageous to mount a phased array antenna onto the curved exterior surface of the host vehicle. Such a conformal phased array antenna however, produces a distorted radiation pattern when the beam is scanned off of broadside.

When the positions of the individual radiating elements on the curved surface of a conformal phased array antenna are projected onto a straight line, the element spacings on the projected line are shortened from those on the curved surface. The change is small at broadside, but increases as the angle of projection off of broadside increases. The shortened projected element spacings cause the effective array amplitude taper to become altered, thereby resulting in antenna pattern distortion. At scan angles other than zero degrees, the taper is skewed; the greater the scan angle, the greater the skewness. It is conceivable that the antenna pattern could be corrected by providing amplitude and phase adjustments at each of the individual radiating elements. However, such a solution would be unwieldy and highly impractical.

OBJECTS AND SUMMARY OF THE INVENTION

It is therefore the primary object of the present invention to provide a simple and practical way to prevent degradation in the antenna pattern of a conformal phased array antenna as its scan angle is varied.

The aforementioned and other objects, features and advantages are achieved in the present invention by adding, at each scan angle, the proper proportion of an anti-symmetric taper to the skewed symmetric taper to restore it to the original broadside taper. This correction is implemented by using a four port variable power divider to combine, in a prescribed amount, the signals fed to (or received from) the sum and difference networks of the conformal phased array monopulse antenna. Concisely stated, the concept behind this invention is to restore, as much as possible, the original aperture sum and difference tapers, by adding, as a function of scan angle, some of the power in the difference network to the power in the sum network and vice versa. Although the technique applies, in general, to any sum and difference illuminations, cosine and sine illumination functions respectively are described herein. They represent typical examples of sum and difference aperture distributions.

BRIEF DESCRIPTION OF THE DRAWINGS

The invention, both as to its organization and operation together with further objects and advantages thereof, may best be understood by reference to the following description taken in connection with the accompanying drawings, in which.

DETAILED DESCRIPTION OF THE INVENTION

Figure 1:
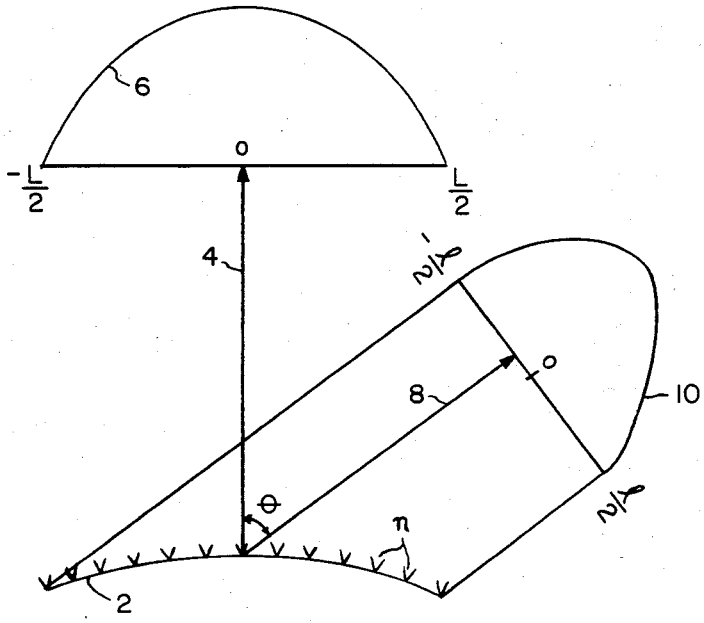
FIG. 1 is a diagram illustrating the cosine aperture illumination of a conformal phased array antenna.

FIG. 1 shows the curved surface 2 of a conformal phased array antenna having a plurality of radiating elements n positioned thereon. The vertical arrow 4 depicts the broadside direction. The effective taper 6 in this direction is a slightly distorted but symmetrical projection of a cos $\pi n/N$ amplitude aperture distribution for the sum pattern, where n is the element number, and N is the total number of elements.

When the antenna is scanned to an angle $\theta$ indicated by the diagonal arrow 8, the effective taper 10 is skewed because the positions of the elements along the line of projection are displaced. For example, the center element's position is no longer at the center of the projection line. The signal amplitude of the center element remains a maximum, and therefore, the maximum amplitude shifts off center. In this manner, the original taper becomes skewed.

Figure 2:
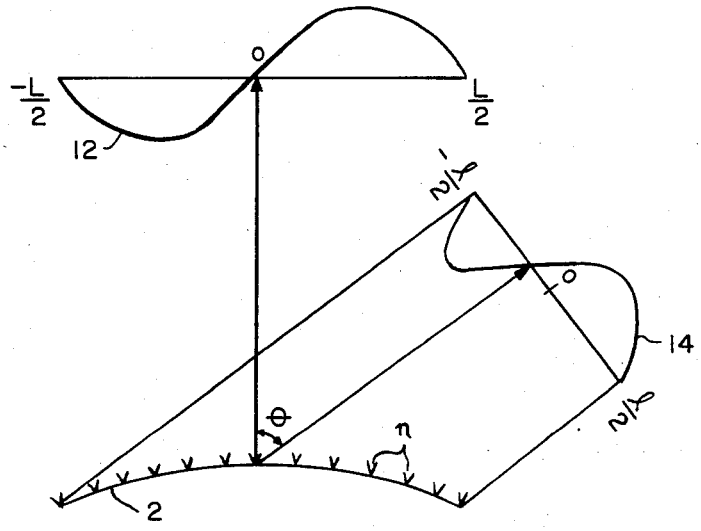
FIG. 2 is a diagram illustrating the sine aperture illumination of a conformal phased array antenna.

FIG. 2 shows the same phenomenon taking place for a sin $2\pi n/N$ amplitude distribution for the difference pattern. The effective taper at broadside is illustrated by the curve 12 and the effective taper at the scan angle $\theta$ is illustrated by the curve 14.

To restore in the scanned projection plane the original cosine and sine aperture tapers 6 and 12 of FIGS. 1 and 2 respectively, a prescribed fraction of the power from the sum and difference channels, are combined. The fraction of the signal amplitudes $k_1$ in the sum channel and $k_2$ in the difference channel are determined using the following equation:

$$\delta_n = E\,(k_1 \cos \pi n/N + k_2 \sin 2\pi n/N - \cos \pi x'/l) \qquad (1)$$

where x' is the coordinate axis in the projection plane, and l is the length of the array in the projection plane.

$$x' = 2R \sin (ns/2R) \sin (\pi/2 - \theta + ns/2R) - R\,(1 - \cos S/2R) \sin \theta$$

$l = 2R \sin S/2R \cos \theta$ $E = \cos^p (\theta - ns/R)$, p is a constant defining the element pattern, R is the radius of curvature, S is the surface length of the array, s is the surface length between two elements, and $\theta$ is the scan angle.

$\delta n$ is solved for each radiating element and the sum of $\delta n$'s, is obtained. The value of $k_2$ is found for which this sum is a minimum. In this manner, $k_2$ is found as a function of $\theta$ and S/R.

Since no power is lost, and the input power is normalized to one, $k_1$ and $k_2$ can not exceed unity, and $$k_1^2+k_2^2=1 \quad (2)$$

The power is distributed into both ports by means of a variable power divider.

Figure 3:
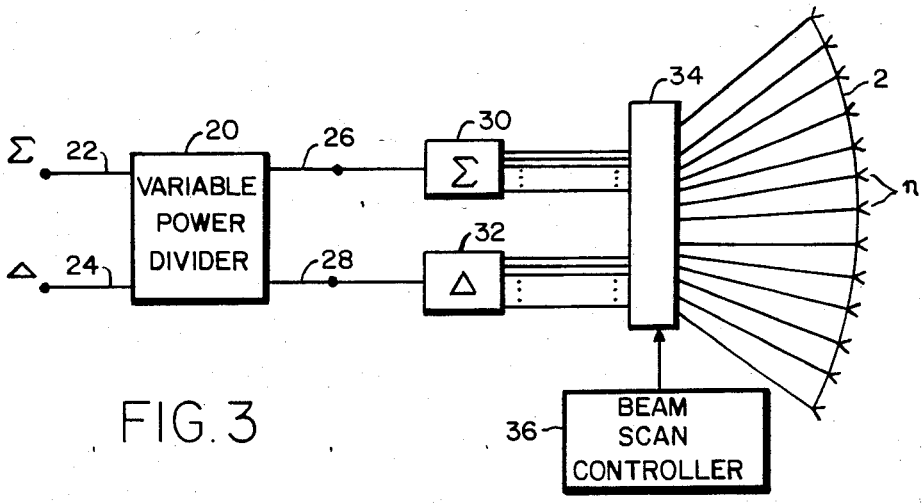
FIG. 3 is a diagram illustrating a conformal phased array monopulse antenna system having the antenna pattern correction means of the present invention.

FIG. 3 shows a variable power divider 20 having input ports 22 and 24 and output ports 26 and 28. Output ports 26 and 28 feed the sum and difference networks 30 and 32 respectively of the conformal phase array antenna. The outputs of the sum network 30 and the outputs of the difference network 32 are coupled to the individual radiating elements n via the power distribution and phase shifter components of beam scanning means 34. Beam scanning or steering signals are applied to the phase shifters by a beam scanning controller 36. The amount of power in each port 26 and 28 for each scan angle is adjusted by the power divider 20 to substantially restore the original sum and difference channel aperture tapers.

Figure 4:
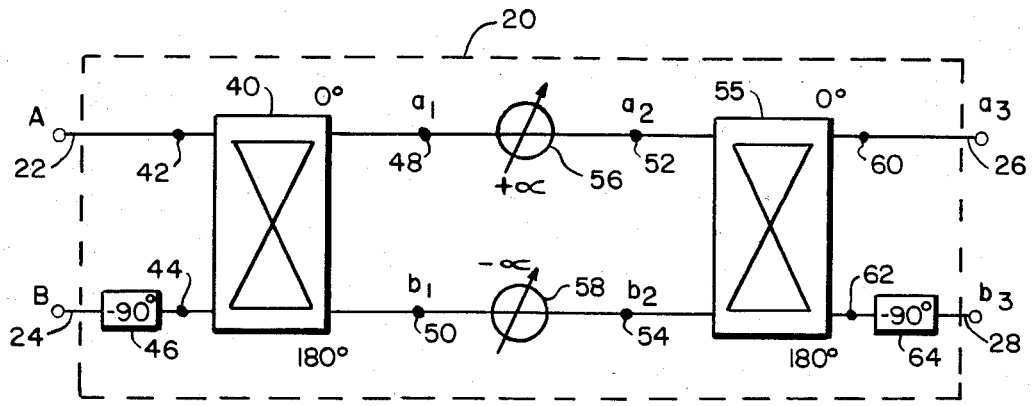
FIG. 4 is a diagram of the variable power divider used in the present invention.

FIG. 4 is a more detailed diagram of a variable power divider 20. Power divider 20 will be seen to include a 180 degree hybrid coupler 40 whose input terminal 42 is directly coupled to input port 22, and whose input terminal 44 is coupled to input port 24 via a −90 degree phase shifter 46. Output terminals 48 and 50 of hybrid 40 are coupled to the input terminals 52 and 54 of a second 180 degree hybrid coupler 55 via variable phase shifters 56 and 58 respectively. Output terminal 60 of hybrid 55 is directly coupled to output port 26 while output terminal 62 is coupled to output port 28 via a −90 degree phase shifter 64.

The phase value settings $+\alpha$ and $-\alpha$ of variable phase shifters 56 and 58 respectively determine the relative power in the output ports 26 and 28. For the transmit case, the voltage at the input port 22 has an amplitude A and is distributed at the output ports 26 and 28 with amplitudes $a_3$ and $b_3$, where:

$$a_3=A\cos\alpha$$

$$b_3=A\sin\alpha$$

The voltages at the individual radiating elements n are determined by the variable power divider 20 and the combined sum and difference networks 30 and 32 shown in FIG. 3. When added and normalized to one, the amplitude $A_n'$ at the $n^{th}$ element is:

$$A_n'=\cos\alpha\cos\pi n/N+\sin\alpha\sin 2\pi n/N$$

For the difference port, the amplitude $B_n'$ at the $n^{th}$ element, is:

$$B_n'=\sin\alpha\cos\pi n/N-\cos\alpha\sin 2\pi n/N$$

For the receive case, reciprocity holds.

The phase value setting, $\alpha$, is determined from:

$$\alpha=\cos^{-1}k_1$$

$$\text{or } \alpha=\sin^{-1}k_2$$

Using Equations (1) and (2) for an isotropic element pattern where the constant p is equal to zero, the value of $k_2$ has been obtained as a function of scan angle, with antenna surface length/radius of curvature as a parameter.

Table 1, below, shows some values of the correction factor $k_2$ as a function of scan angle for antenna surface length/radius of curvature (S/R) equal to 1.07 and 1.60.

TABLE I

| $\theta°$ | $k_2$ S/R = 1.07 | $k_2$ S/R = 1.60 |
|---|---|---|
| 10 | .04 | .07 |
| 20 | .09 | .14 |
| 30 | .14 | .23 |
| 40 | .20 | .34 |
| 50 | .29 | .49 |

Figure 5:
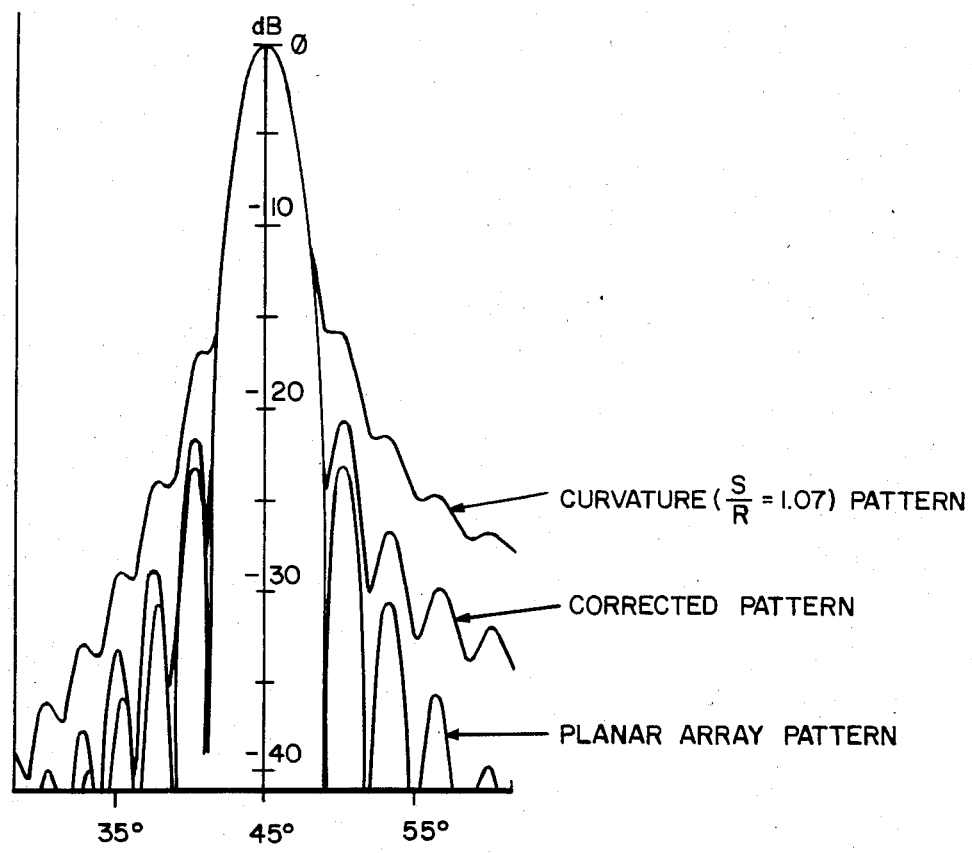
FIG. 5 shows curves of the radiation patterns of a planar array antenna and of a conformal array antenna with isotropic elements, both before and after pattern correction by the present invention.

FIG. 5 shows the planar, uncorrected and corrected sum radiation patterns at a 45 degree scan angle using isotropic elements where the constant p in equation (1) is zero. It is apparent that the mainbeam and first few sidelobes are improved greatly when the foregoing correction is applied.

Figure 6:
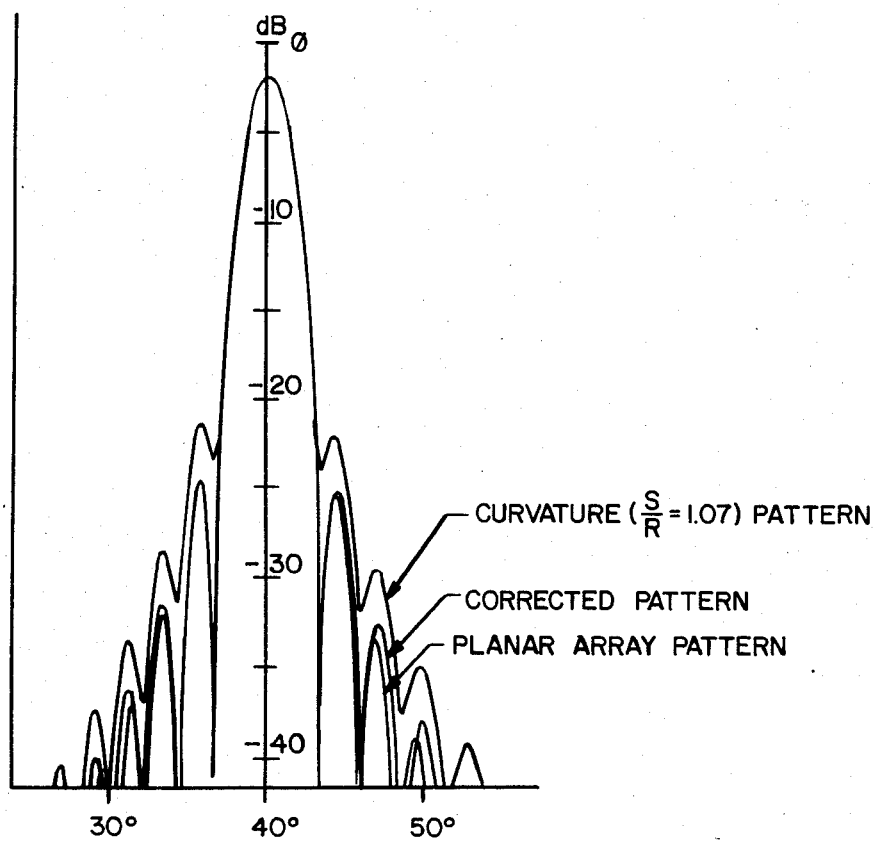
FIG. 6 shows curves of the radiation patterns of a planar array antenna and of a conformal array antenna with conventional elements, both before and after pattern correction by the present invention.

FIG. 6 shows the planar, uncorrected and corrected sum radiation patterns at a 40 degree scan angle using non-isotropic elements where the constant p in equation (1) is 0.75. The associated difference pattern, when uncorrected, exhibited a 17 dB main beam null whereas after correction by the present invention, it exhibited a 34.5 dB null, representing a 17.5 dB improvement in the difference radiation pattern.

Although the invention has been described with reference to a particular embodiment, it will be understood to those skilled in the art that the invention is capable of a variety of alternative embodiments within the spirit and scope of the appended claims.

What is claimed is:

1. A conformal phased array monopulse antenna system comprising:

a plurality of radiating elements arranged along a curved surface;

beam scanning means directly connected to said plurality of radiating elements for varying the scan angle of the beam produced by said radiating elements;

sum and difference networks directly connected to said beam scanning means for producing sum and difference radiation patterns from said plurality of radiating elements; and a variable power divider coupled to said sum and difference networks for redistributing the power applied to said sum and difference networks as a function of said scan angle, and whereby distortions in said sum and difference antenna patterns are corrected.

2. Apparatus as defined in claim 1 wherein said beam scanning means comprises:

a plurality of variable phase shifters coupled to individual ones of said plurality of radiating elements.

3. Apparatus as defined in claim 2 wherein said variable power divider comprises:

a first and a second 180 degree hybrid coupler each having a pair of input terminals and a pair of output terminals; and phase shifting means coupling said pair of output terminals of said first hybrid coupler to said pair of input terminals of said second hybrid coupler.

4. Apparatus as defined in claim 3 wherein said variable power divider further comprises:

a first −90 degree phase shifter coupled to one of said pair of input terminals of said first 180 degree hybrid coupler; and a second −90 degree phase shifter coupled to one of said pair of output terminals of said second 180 degree hybrid coupler.

5. Apparatus as defined in claim 4 wherein said phase shifting means coupling said pair of output terminals of said first hybrid coupler to said pair of input terminals of said hybrid coupler comprises:

a first variable phase shifting element coupled between one of said pair of output terminals of said first hybrid coupler and one of said pair of input terminals of said second hybrid coupler; and a second variable phase shifting element coupled between the other one of said pair of output terminals of said first hybrid coupler and the other one of said pair of input terminals of said second hybrid coupler.

* * * * *